United States Patent [19]

Jureit et al.

[11] 3,958,284

[45] May 25, 1976

[54] BED FRAME CONSTRUCTION

[76] Inventors: John Calvin Jureit, 8901 Arvida Lane, Coral Gables, Fla. 33156; Andrew G. Seipos, 650 NE. 31st St., Apt. 16C, Miami, Fla. 33137

[22] Filed: Dec. 4, 1974

[21] Appl. No.: 529,681

Related U.S. Application Data

[62] Division of Ser. No. 392,224, Aug. 28, 1973.

[52] U.S. Cl. ..... 5/200 R; 5/236 R; 403/406

[51] Int. Cl.[2] ..... A47C 19/00

[58] Field of Search ..... 5/207, 210, 200, 247, 5/248, 234, 263, 351, 236; 267/80, 86, 92, 102; 297/456; 52/DIG. 6; 403/406

[56] References Cited

UNITED STATES PATENTS

| | | | |
|---|---|---|---|
| 773,312 | 10/1904 | D'Arcy | 5/247 |
| 2,917,263 | 12/1959 | Appleton et al. | 52/DIG. 6 |
| 3,127,145 | 3/1964 | McGinty et al. | 52/DIG. 6 |
| 3,680,157 | 8/1972 | Slominski | 5/247 |
| 3,750,201 | 8/1973 | Usamy | 5/263 |

*Primary Examiner*—Paul R. Gilliam
*Assistant Examiner*—Andrew M. Calvert

[57] ABSTRACT

The bed frame includes a pair of side rails, end rails and intermediate slats in coplanar relation. The slats and end rails are secured at opposite ends to the side rails by plates of the type having a plurality of teeth struck to project to one side thereof. Particularly, the plates are embedded on opposite sides of the joints formed between the ends of the slats and end rails on the one hand and the side rails on the other hand. A central support strip of sheet metal underlies the intermediate slats and its ends overlie the end rails. The central support is secured by plates of the foregoing type wherein the teeth pass through the strap and are embedded into the underlying wooden end rails. In one form hereof a corner plate is provided for joining the ends of the end rails to the ends of the side rails. The corner plate includes a sheet metal plate formed to provide channel shaped portions at opposite ends which extend at right angles to one another with inside and outside radii therebetween. Each channel portion has a plurality of teeth struck from its base for embedment into the end or side rail receivable within the channel-shaped end portions. The corner plate has a plurality of upstanding tabs for gripping the lower end of a spring forming a part of the boxspring.

9 Claims, 18 Drawing Figures

FIG. 1
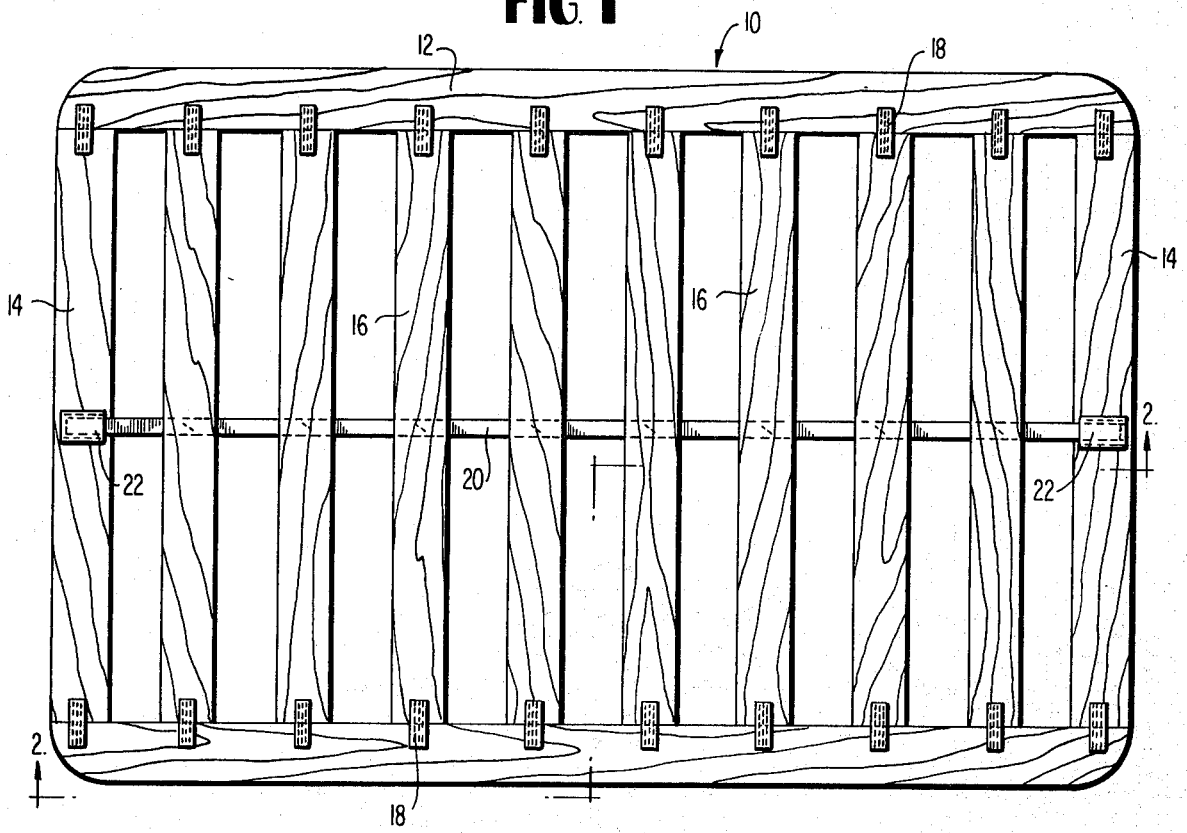
FIG. 2
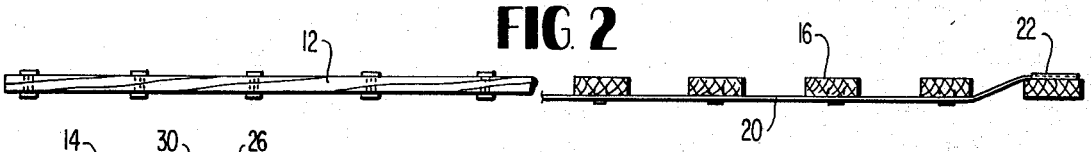
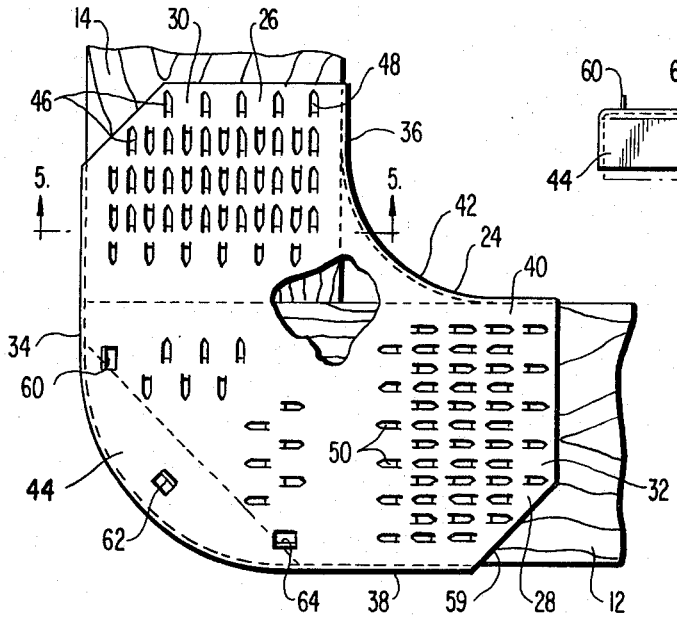
FIG. 3
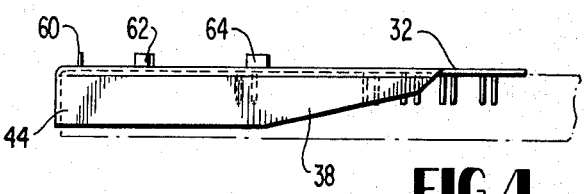
FIG. 4
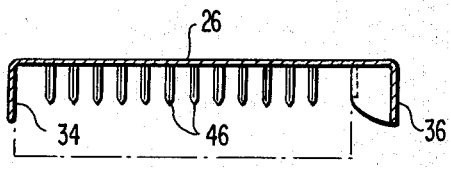
FIG. 5

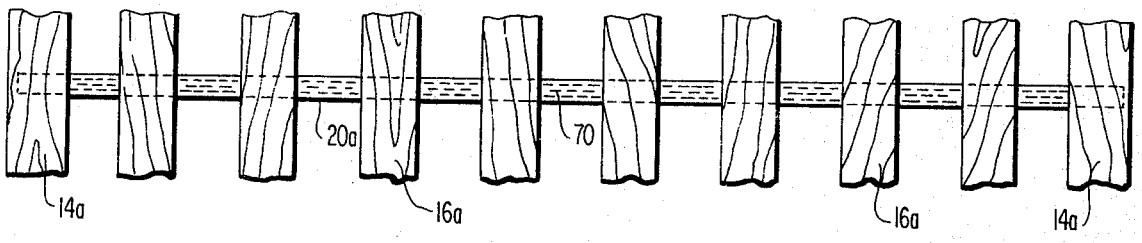
FIG. 6
FIG. 7
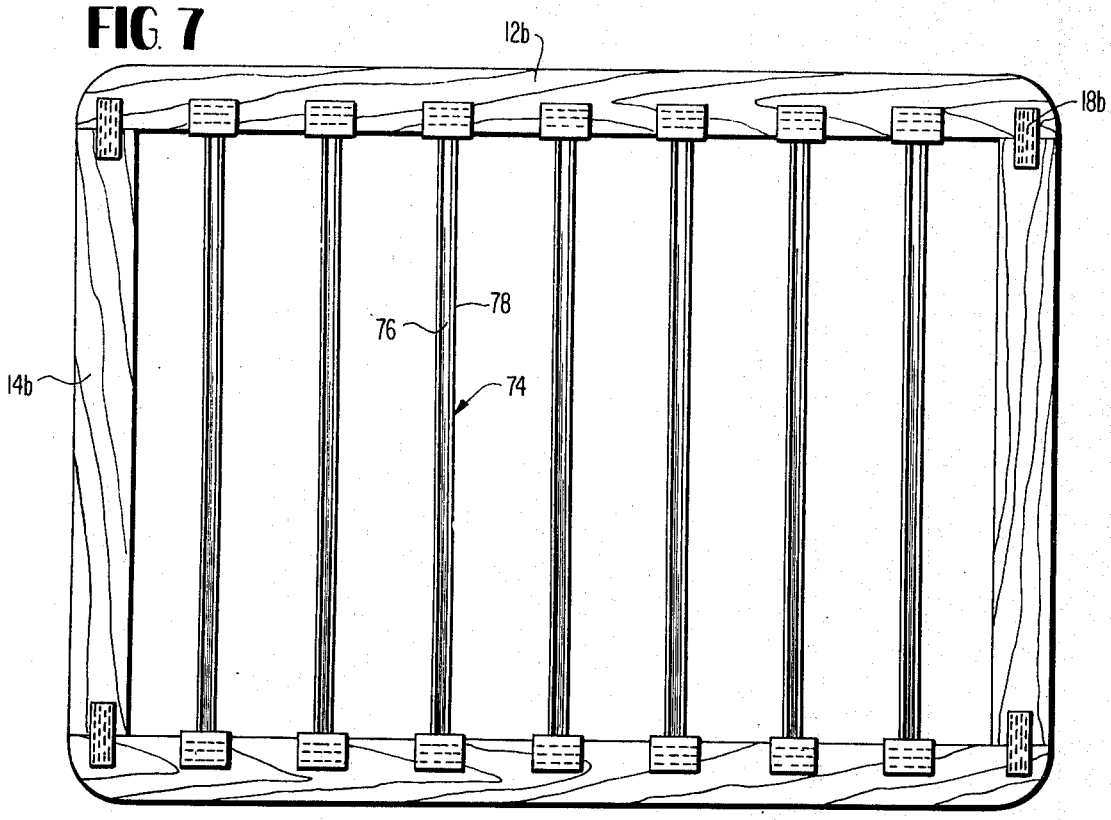
FIG. 8
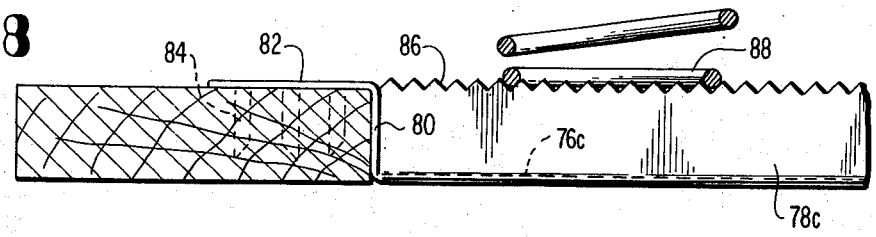
FIG. 9
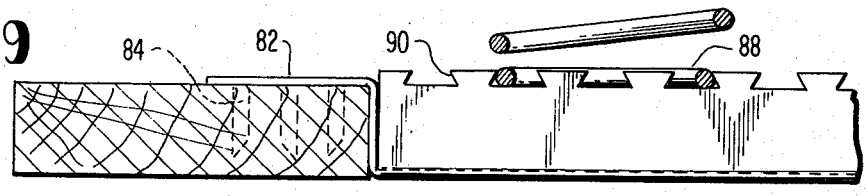

FIG. 10
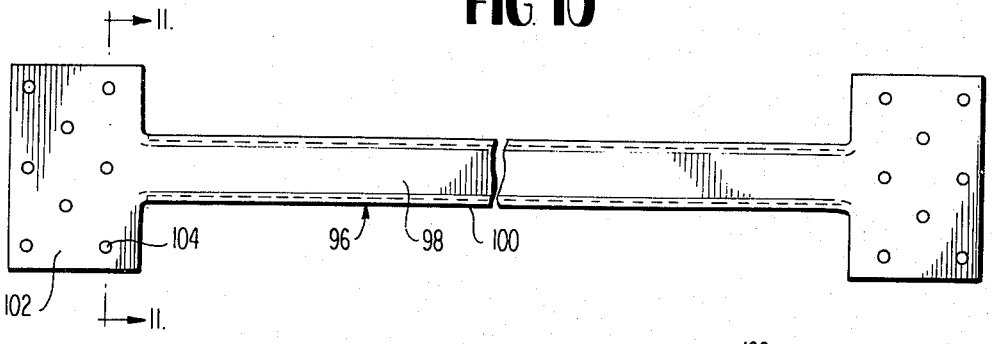
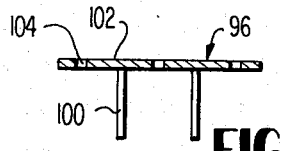
FIG. 11
FIG. 12
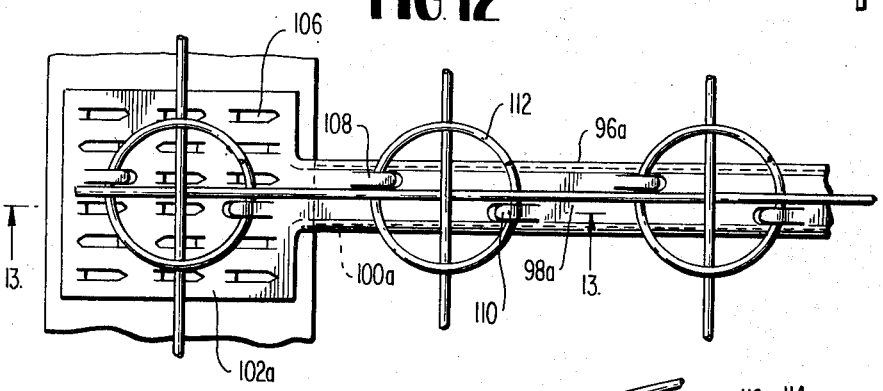
FIG. 13
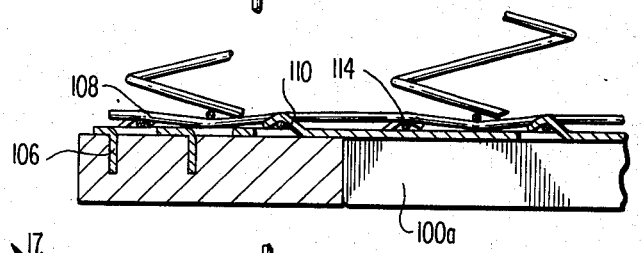
FIG. 15
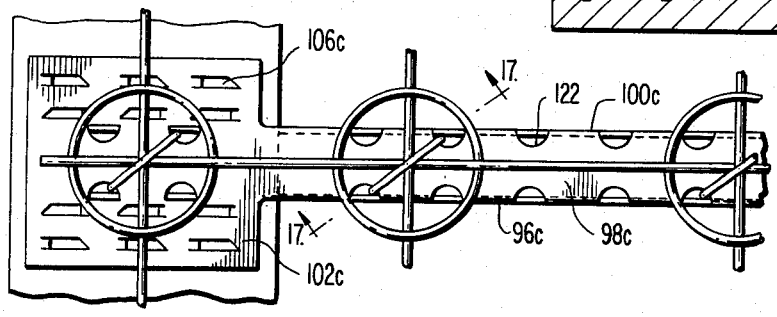
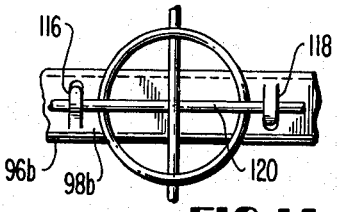
FIG. 14
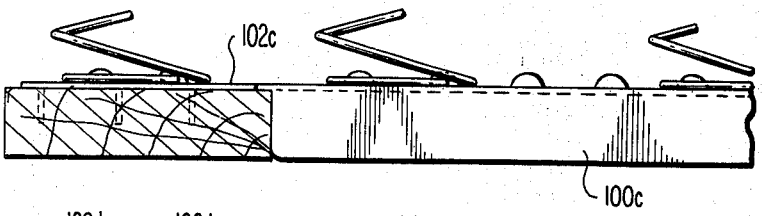
FIG. 16
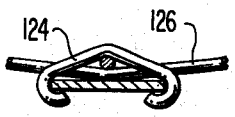
FIG. 17
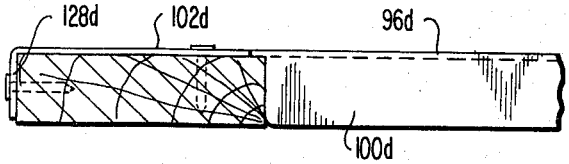
FIG. 18

BED FRAME CONSTRUCTION

This is a division of application Ser. No. 392,224, filed Aug. 28, 1973.

The present invention relates to a bed frame construction and particularly relates to a novel boxspring frame construction and corner connector plate utilized therewith.

Various types of boxspring frames have been proposed and constructed in the past. Most such frames are comprised of side and end rails forming a rectangular frame with intermediate rails or slats spaced longitudinally along the frame between the side rails. Certain conventional constructions require that the slats rest on the side rails for proper support. Furthermore, the juncture of the end and side rails has heretofore been somewhat difficult to form and has required substantial quantities of wood as well as the performance of various cutting operations to achieve the desired corner configuration. Automated construction of bed frames has thus, prior to the present invention, been difficult to achieve.

The present invention provides a bed frame construction which minimizes or eliminates the foregoing and other problems associated with prior bed frame constructions and provides a novel and improved bed frame construction having various advantages in construction, and use in comparison with such prior bed frame construction. Particularly, the present invention provides a bed frame construction comprised of a pair of side rails, a pair of end rails disposed between the side rails in a manner to form a generally rectangular frame and a plurality of intermediate rails or slats which extend between the side rails at longitudinally spaced positions along the bed frame. The end rails and intermediate slats are secured to the side rails, in one form of the present invention, by connector plates of the type having a plurality of teeth struck therefrom to project to one side of the plate. The plates are applied on opposite sides of each joint with the teeth being embedded into both the side rails and intermediate slat or end rails as applicable. Preferably, a plate is applied on each of the opposite sides of the juncture between the end rails and the side rails as well as on each side of the joint between the intermediate slats and the side rails. A steel strap extends longitudinally along the underside of the intermediate slats and has its opposite ends overlying the end rails at locations medially between the side rails. A connector plate of the foregoing type is applied to the ends of the strap and its teeth are punched through the strap ends and embedded into the end rails to secure the strap to the frame. In this manner, the intermediate slats are supported centrally of the frame by the strap. Alternately, the strap may constitute an elongated strip of sheet metal having a plurality of teeth struck therefrom and distributed continuously throughout its length. The teeth are embedded into the undersides of the slats and end rails whereby the slats are supported.

In a further form hereof, the foregoing described connector plates at the juncture of the end and side rails are replaced by one or two corner plates. Particularly, each corner plate is comprised of a sheet metal plate formed to provide generally right-angularly related channels at its opposite ends with inside and outside radii interconnecting between the respective inner and outer flanges of the end portions of the plate. Each channel-shaped end portion has a plurality of teeth struck from its base to project into the channel for embedment into the side or end rail received within such channel-shaped end as applicable. Thus, the corner plate is applied to the bed frame with the channel-shaped ends overlying the ends of the side and end rails, respectively, the teeth of the channel-shaped ends being embedded into the respective rails. The ends of the side rails are preferably cut linearly along an angle whereby the corner of the bed frame is formed by the outer flange or radius interconnecting the channel-shaped end portions of the corner plate. This channel-shaped construction particularly strengthens the joint thus formed. Furthermore, to facilitate securement of the boxsprings to the corner of the bed frame, the corner plates are provided with a plurality of upstanding tabs for locating the corner spring of the boxspring on the plate. The lower end of the spring is passed along respective inner and outer surfaces of the tabs whereby respective displacement of the spring relative to the bed frame is precluded and securing anchoring therefore provided. The corner plates, of course, may be applied to opposite sides of the joints.

From the foregoing; it will be appreciated that the bed frame construction utilizing connector plates as the means for forming the joints between the end and intermediate rails on the one hand and the side rails on the other hand, lends its construction to automated processes. Particularly, the bed frame may be laid out on a jig table similarly as described and illustrated in U.S. Pat. No. 3,328,867 of common assignee herewith and passed through a press whereby the teeth of the connector plates spotted on the jig table in respective overlying and underlying relation to the joints are embedded into the respective rails and slats. Thus, a bed frame may be completed simply by spotting the wooden members and the connectors therefor on the jig and passing the jigged bed frame through a press. Moreover, the slat support strap likewise can be secured to the bed frame in a similar manner. With respect to the corner plates, the press may be specifically configured such that the upstanding tabs are not deformed upon pressing action. Alternatively, the corner plates can be pressed by portable presses such as described and illustrated in U.S. Pat. No. 3,207,406 of common assignee herewith.

In a still further form of bed frame construction hereof, channel-shaped metal members having integrally formed plates at opposite ends are utilized in lieu of conventional wooden slats. The channels are preferably inverted and the end plates carried thereby lie in a plane containing the upper edges of the member to overlie the side rails. The plates have teeth struck integrally therefrom for embedment into the rails whereby the plates support the members from the side rails. Also, the upper edges of the flanges of the channel-shaped members may be serrated or provided with transversely spaced grooves for receiving the lower end portions of the box springs. Thus lateral movement of the box springs is prevented.

In a still further form of bed frame construction hereof, the channel-shaped members with integrally formed plates at the opposite ends are also utilized in lieu of slats but with the channel-shaped members inverted in comparison with those described previously. Hold down tabs are struck from the base of the channel members to project upwardly to secure the ends of the springs to the bed frame. The hold down tabs comprise teeth which can be struck either parallel to or transverse to the long axis of the channel-shaped slats to project upwardly and for subsequent forming over the lower coils of the bed spring. A variation of this embodiment provides for oppositely opening tabs whereby the bed springs are snapped into place by a twisting motion. A further variation provides for cut-outs formed along the base of the channel for receiving clinch ring anchors or locking clinch type staples for holding the lower ends of the bed spring.

Accordingly, it is a primary object of the present invention to provide a novel and improved bed frame construction requiring for its formation a minimum quantity of wood and a frame of increased strength.

It is still another object of the present invention to provide a novel and improved bed frame construction which is particularly capable of being formed by automated processes.

It is a further object of the present invention to provide a novel and improved bed frame construction having a uniquely configured corner plate for joining the side and end rails of the bed frame one to another.

It is still a further object of the present invention to provide a novel and improved bed frame construction wherein the corner plate is further configured to provide support for and to accurately locate the corner springs in the box spring construction.

These and further objects and advantages of the present invention will become more apparent upon reference to the following specification, claims and appended drawings wherein:

FIG. 1 is a plan view of a bed frame constructed in accordance with the present invention;

FIG. 2 is a cross-sectional view thereof taken about on lines 2—2 in FIG. 1;

FIG. 3 is a fragmentary enlarged view of the joint between a side and end rail and illustrating the novel and improved corner plate hereof;

FIG. 4 is a side elevational view of the joint and plate illustrated in FIG. 3;

FIG. 5 is a cross-sectional view thereof taken about on line 5—5 in FIG. 3.

FIG. 6 is a fragmentary plan view illustrating another form of the central tension strap for the frame;

FIG. 7 is a view similar to FIG. 1 of another form of bed frame constructed in accordance with the present invention;

FIGS. 8 and 9 are enlarged fragmentary cross-sectional views of the joints between the side rails and the intermediate members with respective different forms of the intermediate members;

FIG. 10 is a plan view of a further form of a metal slat for use in a bed frame constructed in accordance with the present invention;

FIG. 11 is a cross-section view thereof taken generally about on line 11—11 in FIG. 10;

FIG. 12 is a fragmentary plan view of a still further form of metal slat construction and illustrating coil spring hold down tabs;

FIG. 13 is a cross-sectional view thereof taken about on line 13—13 in FIG. 12;

FIG. 14 is a view similar to FIG. 12 illustrating a variation of a coil spring hold down tab;

FIG. 15 is a view similar to FIG. 12 and illustrating a further form of metal slat construction;

FIG. 16 is a cross-sectional view thereof;

FIG. 17 is an enlarged cross-sectional view thereof taken generally about on line 17—17 in FIG. 15;

FIG. 18 is a view similar to FIG. 16 and illustrating a further variation of a channel-shaped slat.

Referring now to the drawings, particularly to FIG. 1, there is illustrated a bed frame generally designated 10 and comprised of a pair of side rails 12, a pair of end rails 14, and a plurality of intermediate slats 16. It will be appreciated that when finally assembled, the end rails are secured between the side rails at opposite ends of the frame with the slats 16 secured at the longitudinally spaced positions therealong and between the side rails 12. The ends of the intermediate slats 16 and rails 14 are secured to the side rails 10 by discrete elongated connector plates applied to each of the opposite sides of each joint thereof. Particularly, the plates 18 comprise elongated sheet metal plates having a plurality of elongated, nail-like teeth struck or formed therefrom to project to one side for embedment into the wooden rails or slats as applicable. Such plates 18 may be of the type described and illustrated in U.S. Pat. No. 2,877,520 of common assignee herewith. In brief, the teeth are struck to form a plurality of longitudinally extending rows thereof leaving a plurality of elongated slots in the plate. As illustrated in FIG. 2, the plates are applied to the opposite sides of the joints formed by the side rails and slates on the one hand and the side rails and the end rails on the other hand. In order to form a secure joint between the end rails and side rails, a plate of a similar type is provided on each of the opposite sides of the joint thus formed. A larger connector plate, however, or one of like size securing the slats and side rails could be utilized. It will be appreciated that with the plate thus applied, the end rails, side rails, and intermediate slats are maintained in coplanar relation one with the other with the connector plates forming secure joints therebetween to rigidize the frame.

Also illustrated in FIG. 1, there is provided a longitudinally extending strap 20 formed of sheet metal and which strap underlies the intermediate slat 16 to provide support. Particularly, the strap 20 underlies each slat 16 and has opposite ends in overlying relation to the end rails 14 as best illustrated in FIG. 2. The strap 20 lies centrally or medially along the frame and is secured at opposite ends to the end rails 14 by plates 22 of the type previously described. Particularly, the plates 22 have teeth which extend through the end portions of strap 20 and into the wooden end rails 14. In applying the plates 22, the teeth preferably are driven through the end portions of the strap although it will be appreciated that preformed holes in the end portion of the strap could be provided if desired. Similar plates can be provided to secure the strap to each slat or selected slats and in a like manner as described above.

The foregoing bed frame manufacture can be readily fabricated in an automated manner. For example, the side and end rails and intermediate slats can be disposed on a jig with the connector plates 18 disposed on the jig on opposite sides of the joints, similarly as trusses are formed as disclosed in U.S. Pat. No. 3,238,867. Likewise, strap 20 can be located under the slats 16 and connector plates 22 disposed in overlying relation relative to the end portions of the straps on the end rails 14. The jigged bed frame can then be indexed through a press as disclosed in that U.S. Pat. No. 3,602,237 whereby the teeth of the connector plates 18 and 22 are sequentially driven into the portions of the wooden frame members adjacent the joints. Alternatively, the bed frame members and plates therefor can be jigged and the press indexed to move along the jig table as disclosed in U.S. Pat. No. 3,603,244. As a still further and preferable method of fabrication, the machine disclosed in copending application Ser. No. 317,095 filed Dec. 20, 1972 may be utilized to both form the plates utilized in the construction of the bed frame as illustrated in FIG. 1 as well as apply them to the joints. It will thus be appreciated that the foregoing bed frame construction can be readily and easily fabricated and in a manner utilizing a minimum quantity of wood.

Referring now to FIGS. 3–5, there is disclosed a joint between end rail 14 and side rail 12 which may be utilized in lieu of the joint illustrated in FIG. 1. Particularly, the joint illustrated in FIGS. 3–5 utilizes a corner bracket 24 which has a generally channel shape and opposite end channel portions 26 and 28 arranged at right angles one to the other. Each channel-shaped end portion 26 and 28 is comprised of a base 30 and 32, respectively. Base 30 has depending flanges 34 and 36 along its opposite sides while base 32 has depending flanges 38 and 40 along its opposite sides which depend in a like direction as flanges 34 and 36 depend from base 30. Flanges 36 and 40 form right angle continuations of one another with the connecting flange 42 therebetween defining an internal arcuate radius. Likewise, flanges 38 and 34 form right angle continuations of one another with the connecting flange 44 therebetween defining an outer radius. Each base portion 30 and 32 is provided with a plurality of teeth struck or formed therefrom to project to one side thereof. The teeth 46 struck from base portion 30 are disposed in longitudinally extending rows and have slots 48 left in base portion 30 thereof extending parallel to the direction of rail 14. The teeth 50 are struck from base portion 32 to lie in longitudinally extending rows thereof with the slots left in base portion 32 extending parallel to rail 12. The teeth struck from the end portions 26 and 28 are struck throughout their surface and terminate along a diagonal extending between the inner and outer radii 42 and 44, respectively. The direction in which the teeth are struck is at right angles one to the other in order to obtain maximum strength in tension in each of the rail members.

To form the corner joint, between the end and side rails, the corner plates are disposed over the end portions of the end and side rails and the teeth of the end sections 26 and 28 are embedded into such rails. It will be appreciated that the channel-shaped end portions receive the ends of the rails and provide lateral support therefor. Also, as illustrated in FIG. 3, the end of the side rail is cut along a diagonal indicated 59 in order to insure that the side rails are receivable within the corner brackets. The corner brackets may be applied by the press described in the foregoing U.S. Pat. No. 3,602,237 or may be applied individually by a C-clamp press, for example, the type disclosed in U.S. Pat. No. 3,207,406 of common assignee herewith. Also, it will be appreciated that the corner plate can be applied to one or both of the opposite sides of the corner joint as desired depending upon the strength required.

To facilitate connection of the corner box springs to the corner of the bed frame and particularly to the corner plate, the plate is formed to provide a plurality of upstanding tabs 60, 62 and 64. These tabs are arranged along the arc of a circle corresponding to the arc of the lower end of the corner box spring.

Accordingly, the spring can be disposed about the tabs as illustrated in FIG. 3 with tab 62 lying on the inside of the spring and end tabs 60 and 64 lying outside of the spring. The tabs can be peened over to secure the spring to the corner bracket.

Referring now to FIG. 6, there is illustrated a plurality of wooden slats 16*a* disposed between end rails 14*a*. In this form, however, the central band or strap 20*a* or two or more of such bands for frames of substantial width are provided substantially continuously throughout its length with a plurality of elongated nail-like teeth struck to project to one side. Strap 20*a* is tensioned along the underside of the frame and the nails 70 are embedded into the undersides of the slats 16*a* as well as into the undersides of the end rails 14*a*. In this manner, the intermediate slats 16*a* are mutually supported one from the other and from the end rails 14*a*.

FIG. 7 illustrates a form of bed frame construction in accordance with the present invention. In this form the side and end rails 12*b* and 14*b*, respectively, are secured one to the other by connector plates 18*b*, of the type previously described, or may be secured one to the other by the corner plates previously described. In this form, however, the wooden slats are replaced by elongated generally channel-shaped sheet metal members 74, each member having a base 76 and a pair of side flanges 78. As illustrated, at each of the opposite ends of the channel members 74, the base 76 is extended at 80 and bent substantially normal to the base and between the flanges 78. This extension is then reversely bent to provide an endwise extending plate 82 in a plane common to the edges of flanges 78. Each of plates 82 is provided with a plurality of slender elongated nail-like teeth 84 for embedment into the side rail. Thus, the intermediate channel-shaped member 74 can be spotted along the length of the bed frame at the appropriate positions and the teeth of the end plates 82 are embedded into the end rails by suitable presses. Note that the channel lies substantially in coplanar relation with the side and end rails 12*b* and 14*b*, respectively.

Referring to FIG. 7, the upper edges of the flanges 78*c* may be serrated as indicated at 86. The lower coils of the box springs may thus be received along the serrated edge and thus prevented from lateral movement. In FIG. 9, the upper edge of flanges 78*c* are provided with a plurality of grooves 90, in this case dove-tail shaped grooves. The lower coils of the coil springs likewise may be received within the dove-tail shaped grooves 90 and similarly prevented from lateral movement.

FIG. 10 illustrates a further form of metal slat construction comprised of a generally elongated channel-shaped sheet metal slat 96 having a base 98 and downwardly extending side flanges 100. As illustrated, each of the opposite ends of slat 96 is provided with a flat plate 102 which extends beyond the ends of flanges 100 and has a plurality of openings 104 formed therein. To form a bed frame utilizing slat 96, these slats are spotted along the length of the frame at selected positions with the plates 102 overlying the side rails. Nails are thereafter inserted through the openings 104 in each of the opposite end plates 102 whereby the slat is nailed to the side rails.

In FIGS. 12 and 13 there is illustrated a variation of the slat ilustrated in FIG. 10. The slat 96*a* in FIG. 12 comprises an elongated channel-shaped member having a base 98*a*, depending flanges 100*a* and flat plates 102*a* formed at its opposite ends. However, in this form, plates 102*a* are provided with integrally struck teeth 106 for embedment into underlying side rails by appropriate pressing apparatus once the slats are located at selected positions along the bed frame. Also, and in this form of slat, pairs of longitudinally extending tabs 108 and 110 are formed to project upwardly from the base 98*a* of the slat at transversely spaced positions therealong. Tabs 108 and 110 are struck such that the slots in the base 98*a* extend from the tabs in opposite directions and toward the opposed tab. In this manner, the lower portion 112 of the bed spring coil can be inserted below tabs 108 and 110 with the tabs being subsequently deformed over the lower coil spring portion 112 as indicated at 114 in FIG. 13. Thus, tabs 108 and 110 provide for ready securement of the box spring to the slats and hold down of the spring. The hold down tabs are also provided in the end plates 102*a*. Thus, in lieu of forming a pair of teeth downwardly, such pair can be formed in the opposite direction to comprise hold down tabs whereby the bed spring coils along the sides of the frame can also be held down on top of and firmly secured to the side rails.

Referring to FIG. 14, the base portion 98*b* of the channel-shaped slat 96*b* may be provided with hold down tabs 116 and 118 struck upwardly therefrom. These tabs extend normal to the longitudinal axis of slats 96*b* and in opposite directions whereby the spring rod 120 can be readily placed below the tabs, for example by a twist, nap-in, placement procedure. The tabs 116 and 118 may thereafter be deformed downwardly to lock the spring 120 in place.

Referring now to the embodiment illustrated in FIG. 15, there is illustrated a further form of channel-shaped metal slat construction 96*c* having a base 98*c*, depending side flanges 100*c* and end plates 102*c*. The plates 102*c* are provided with integrally struck teeth 106*c* for embedment thereof into the side rails of the bed frame. The teeth 106*c* are different in configuration in comparison with the teeth 106 of FIG. 12 and therefore illustrative of a further configuration and arrangement of teeth in the plates at the opposite ends of the slats. In this form, the channel-shaped slats 96*c* are provided with semi-circular cut-outs 122 formed in the base 98c thereof. The cut-outs 122 are spaced longitudinally along opposite sides of the base of the slat. Referring to FIGS. 16 and 17, the cut-outs 122 cooperate with clinch ring anchors 124 for securing the spring 126 to the slats. Each clinch ring anchor comprises a generally V-shaped rod or wire formed to provide hooks at opposite ends. The hooks are received within selected cut-outs 122 with the lower spring coils between the slats and the anchors 124 whereby the bed springs are held down onto the slats and bed frame.

In FIG. 18, there is illustrated a generally similar channel-shaped slat 96d having depending flanges 100*d* and an end plate 102*d*. In this form, end plate 102*d* is extended in a longitudinal direction and turned downwardly to form a flange 128*d*. The flange 128*d*, as well as plate 102*d*, may be provided with preformed openings whereby nails are receivable through the openings for embedment into the top and outer sides of the side rail. Alternately, the plate 102*d* may be provided with teeth, for example the teeth illustrated at 106 in FIG. 12 or 106*c* in FIG. 15 with holes provided in flange 128 for driving the nails.

Accordingly, it will be appreciated that the foregoing described bed frame fully accomplishes the objects of the present invention in that there is provided a bed frame which is sturdy in construction, utilizes a minimum quantity of wood, and which can be readily fabricated utilizing automated processes. Furthermore, the bed frame hereof provides a novel and unique corner bracket whereby the corner of the bed frame is substantially strengthened.

The invention may be embodied in other specific forms without deparing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A bed frame comprising a pair of elongated wooden members for forming the substantially rigid side members of the frame, a pair of wooden end members disposed between said side members adjacent opposite ends thereof, a plurality of longitudinally spaced sheet metal members extending transversely between said side frame members intermediate of said end members and in substantial coplanar relation with said side and end members, means for joining the opposite ends of each said intermediate member to the respective side members including a plate integrally formed with said intermediate member at each of its opposite ends, each of said end plates having a plurality of teeth struck to project to one side and embedded into the corresponding side member for supporting said intermediate member from said side members, each of said intermediate members being channel shaped with the end plates being formed from endwise continuations of the base portion of the channel and extending therefrom substantially within or coincident with one of the parallel planes containing the base and the opposite edges of the channel shaped members, and means for connecting the ends of said members to the respective side members.

2. A bed frame according to claim 1 wherein the edges of the flanges of the channel-shaped intermediate members are notched to receive lower coil portions of a box spring coil.

3. A bed frame according to claim 2 wherein said flange edges are serrated to form said notches.

4. A bed frame according to claim 2 wherein said flange edges are provided with a plurality of dove-tailed grooves to form said notches.

5. A bed frame according to claim 1 wherein said connecting means include a plurality of sheet metal plates, each of said plates having a plurality of elongated nail-like teeth formed to project to one side thereof, said plates being applied to at least one side of the joint between each said end member and said side member with the plates spanning the joints and the teeth thereof embedded into the wooden members forming the respective joints.

6. A bed frame according to claim 1 including tabs carried by said intermediate members for securing one or more of the lower coils of a box spring to the bed frame.

7. A bed frame according to claim 6 wherein said tabs are formed from said intermediate members and project upwardly from said bed frame, said tabs being formed over one or more lower coils of the box spring to secure the latter to the intermediate members.

8. A bed frame according to claim 1 wherein each of said intermediate members has a plurality of slots formed therein at spaced locations therealong, and means cooperable with said slots for securing one or more of the lower coils of a box spring to said bed frame.

9. A bed frame according to claim 1 wherein each of said plates has an end flange projecting generally normal thereto for overlapping the outer lateral edge of the side rails, and means securing each of said flanges to the corresponding side rail.

* * * * *

UNITED STATES PATENT AND TRADEMARK OFFICE

CERTIFICATE OF CORRECTION

PATENT NO. : 3,958,284

DATED : May 25, 1976

INVENTOR(S) : John C. Jureit and Andrew G. Seipos

It is certified that error appears in the above-identified patent and that said Letters Patent are hereby corrected as shown below:

Col. 3, line 55, "cross-section" should read --cross-sectional--.

Col. 6, line 66, "ilustrated" should read --illustrated--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*